United States Patent [19]

Hegnauer

[11] 4,424,992

[45] Jan. 10, 1984

[54] CORD FEED AND DELIVERY DEVICE SUPPLYING A KNOTTER

[76] Inventor: Ulrich Hegnauer, Sandackerweg 12, CH-3363 Oberoenz, Switzerland

[21] Appl. No.: 209,103

[22] PCT Filed: Jan. 25, 1979

[86] PCT No.: PCT/CH79/00007

§ 371 Date: Nov. 2, 1979

§ 102(e) Date: Oct. 18, 1979

[87] PCT Pub. No.: WO79/00681

PCT Pub. Date: Sep. 20, 1979

[30] Foreign Application Priority Data

Mar. 2, 1978 [CH] Switzerland ..... 2240/78

[51] Int. Cl.[3] ..... A01D 59/04; B65H 69/04

[52] U.S. Cl. ..... 289/2

[58] Field of Search ..... 289/2

[56] References Cited

U.S. PATENT DOCUMENTS 2,276,919 3/1942 Brassel et al. ..... 289/2 X 3,583,735 6/1971 Born ..... 289/2

FOREIGN PATENT DOCUMENTS 438143 11/1967 Switzerland .

487020 4/1970 Switzerland .

*Primary Examiner*—Louis Rimrodt

*Attorney, Agent, or Firm*—Saul Jecies

[57] ABSTRACT

A device containing a retractable stitcher (3) whose inner end is provided with a unilaterally projecting eyelet (12). The binding cord (18) is fed from a cord tensioning device (20) and runs through the eyelet (12) and is wound with the section (2) that leaves the eyelet around the item (1) to be tied up and has its end held by one of the grippers (17) of the knotter (4). A driver (11) grips the cord section (2) entering the eyelet (12) and delivers it to one of the grippers (17) in the knotter (4). The driver (11) is attached to one end of a push rod (9) which is actuated by a main shaft (5) through a connecting rod (7a) and a rocking lever (9).

2 Claims, 3 Drawing Figures

CORD FEED AND DELIVERY DEVICE SUPPLYING A KNOTTER

The invention concerns a cord fee and delivery device supplying a knotter wherein the cord is gripped by one of the grippers of the knotter and where the item to be tied up is moved parallel with the binding plane relative to the knotter.

In a well-known manner (see CH-Pat. Nos. 438143 and 487020 owned by the assignee) the binding cord is moved partly around the item to be tied up, when binding packages and parcels by means of an angular frame operating together with a knotter mechanism. For the purpose of binding larger items, particularly such as palletized goods, such an angular frame is, however, too unwieldy.

This drawback will be eliminated by the cord feed and delivery system according to this invention.

The drawing shows, as an example, an embodiment of the object of the invention.

Figure 1:
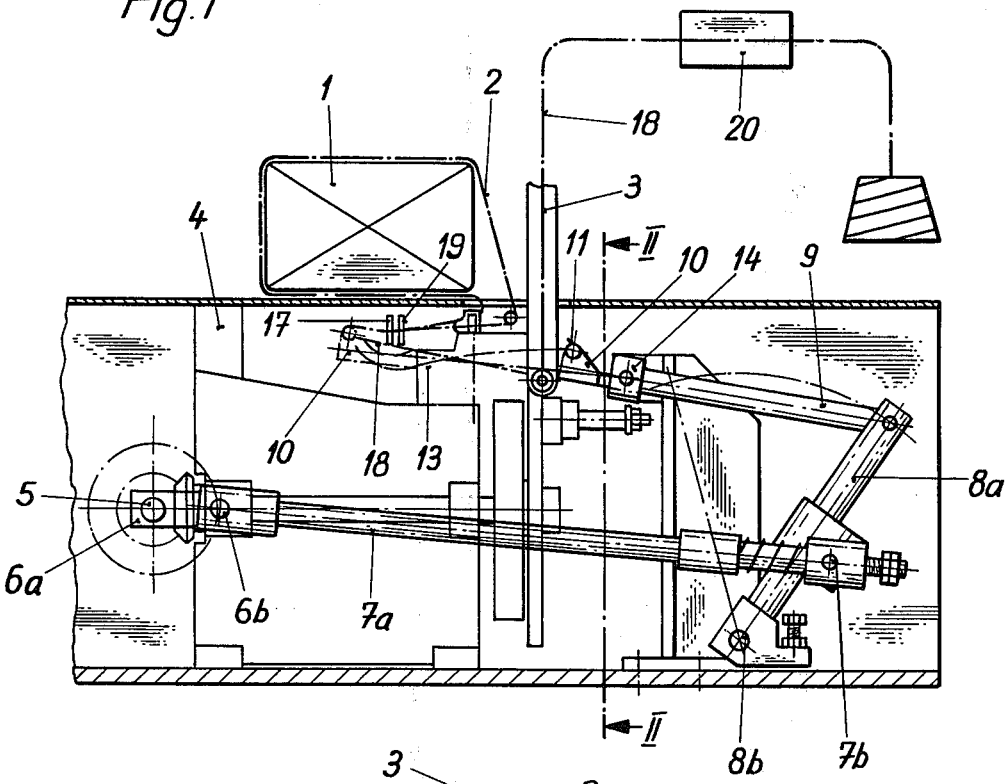
FIG. 1 is a diagrammatic view of the device.
Figure 2:
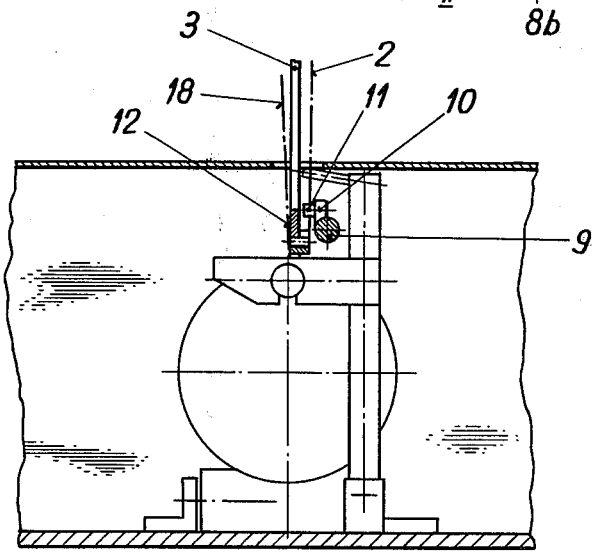
FIG. 2 is a sectional view along lines II—II of FIG. 1.

The cord feed and delivery device shown here is driven by a main shaft 5 in synchronism with a knotter 4 (FIG. 1). On the main shaft 5 is mounted a crank 6*a* which is connected through a crank pin 6*b* to a connecting rod 7*a*. The latter is connected by an articulated pin 7*b* to a rocking lever 8*a* which is pivoted around a rocker axle 8*b*. The rocking end of rocking lever 8*a* is hinged to a push and pull rod 9 which is movable in a pivoted slide bearing 14. The free end of the pushand pull rod 9 is carrying a push rod head 10 (FIGS. 1 and 2). The latter displays on the side turned away from thr rocker axle 8*b* a projecting part to which is fitted a cord driver 11 projecting perpendicularly from the plane of motor of the rocking lever 8*a*.

Perpendicular to the main shaft 5 and parallel to the plane of the rocking lever 8*a* is run a cord feed stitcher 3 which can be moved in its longitudinal direction and one end of which is positioned, when withdrawn, closely in front and underneath the withdrawn push rod head 10. This stitcher end is provided with a unilaterally projecting eyelet 12 (FIG. 2). The cord section 2 adapted for winding around the item 1 to be tied up enters at the projecting side of the eyelet 12 and runs from the other side (cord 18) of the eyelet to the tensioning device 20. The end of the cord is held at a gripper 17 in the knotter 4.

The driver 11 at the end of the push rod 9 gripps the cord running in the eyelet 12 and carries it to one of the grippers 17 of the knotter 4. To prevent the cord 2 from being touched by the blade 19 of the knotter 4, the cord driver 11 carries out an evasive movement in a curve 13 which is determined by the pivotal movement of bearing 14. The stitcher 3 will remain in its withdrawn position until the driver 11 has delivered the cord 2 to the knotter 4.

Figure 3:
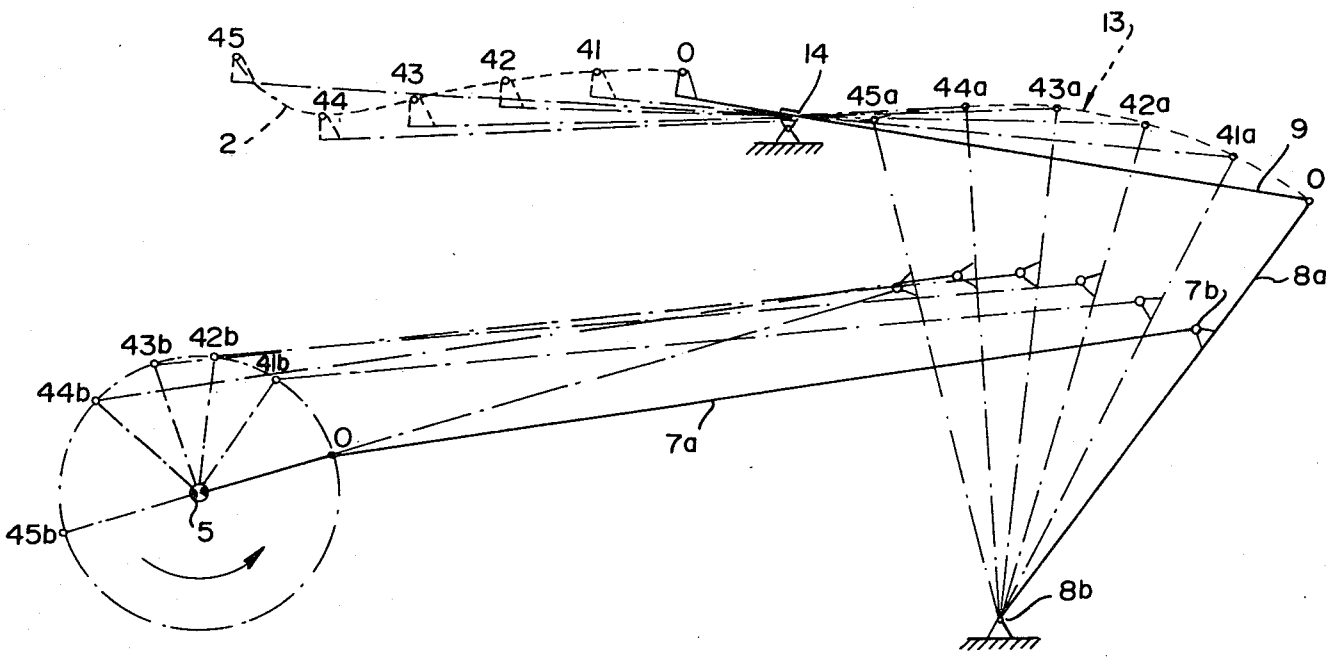
FIG. 3 illustrates the curve the cord driver carries out as an evasive movement.

One example of obtaining the curve 13 is illustrated in FIG. 3. The starting position is indicated by the sign "0". The curve 13 is shown in the dotted line. The motion of the parts producing curve 13 is indicated by numerals 41*a*, 42*a*, 43*a*, 44*a* and 45*a*. Movement of the main shaft 5 producing this curve is indicated by the numerals 41*a* to 45*a*. The other portion of the curve 13 is indicated as 41, 42, 43, 44 and 45. The numerals contained in FIG. 3 correspond to the numerals in FIGS. 1 and 2, namely, 5, 7*a*, 8*a*, 8*b*, 9 and 15.

The curved path 13 can be produced by any other mechanical device, e.g. by a controlled curve with feeling roller instead of the pivoted bearing 14.

The cord feed stitcher 3 can be moved by mechanical means in active connection with the main shaft 5 or by hand.

The knotting process is described in detail in the patent specifications CH Pat. No. 438143 and CH Pat. No. 487020 referred to above. U.S. Pat. No. 3,583,735 is the equivalent of Swiss Pat. No. 487,020.

I claim:

1. A machine for binding up large sized packages of bundles, particularly packages and bundles which are palletized, comprising a binding cord;

driving means;

a crank shaft operatively connected to said driving means;

connecting means connected at one end to said driving means;

rocking lever means connected to the other end of said connecting means;

push rod means connected to said rocking lever means and having a free end;

a push rod head carried by said free end of said pushing rod means;

cord gripping means adapted to grip said binding cord;

cording driving means for moving said binding cord to said gripping means;

eyelet means for allowing said binding cord to pass therethrough;

a tensioning device for tensioning said binding cord passed through said eyelet means; and a knotter for knotting said binding cord.

2. A cord feed and delivery device according to claim 1, comprising:

a pivoted slide bearing, said push rod means running through said pivoted slide bearing in a manner so that said driver is moved in a curve.

* * * * *